US008708100B2

(12) United States Patent
Schwoerer

(10) Patent No.: US 8,708,100 B2
(45) Date of Patent: Apr. 29, 2014

(54) RAIL-GUIDED CLIMBING SYSTEM

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 694 days.

(21) Appl. No.: 11/993,022

(22) PCT Filed: Jun. 20, 2006

(86) PCT No.: PCT/DE2006/001050

§ 371 (c)(1),
(2), (4) Date: Dec. 19, 2007

(87) PCT Pub. No.: WO2007/000139

PCT Pub. Date: Jan. 4, 2007

(65) Prior Publication Data

US 2010/0038518 A1 Feb. 18, 2010

(30) Foreign Application Priority Data

Jun. 29, 2005 (DE) ..... 10 2005 030 336

(51) Int. Cl.
*E04G 9/00* (2006.01)

(52) U.S. Cl.
USPC ..... 182/20; 425/63; 249/18; 182/82; 182/87

(58) Field of Classification Search
USPC ..... 182/2.1, 2.2, 2.3, 82, 87; 249/18–22; 425/63, 65; 264/33
See application file for complete search history.

(56) References Cited

U.S. PATENT DOCUMENTS

| | | | | | |
|---|---|---|---|---|---|
| 2,649,643 | A | | 8/1953 | Schutte | |
| 3,779,678 | A | * | 12/1973 | Scheller | 425/65 |
| 4,040,774 | A | * | 8/1977 | Scheller | 425/65 |
| 4,060,358 | A | * | 11/1977 | Fougea | 425/65 |
| 4,290,576 | A | * | 9/1981 | Schworer | 249/20 |
| 4,540,150 | A | * | 9/1985 | Tzincoca | 249/20 |
| 4,562,989 | A | * | 1/1986 | Scheller | 249/17 |
| 4,611,784 | A | * | 9/1986 | Gallis | 249/20 |
| 4,917,346 | A | * | 4/1990 | Mathis | 249/20 |
| 4,962,828 | A | * | 10/1990 | Duncan | 182/82 |
| 5,000,287 | A | * | 3/1991 | Schworer | 182/82 |
| 6,557,817 | B2 | * | 5/2003 | Waldschmitt et al. | 249/20 |
| 7,513,480 | B2 | * | 4/2009 | Bergaretxe et al. | 249/20 |
| 2005/0217934 | A1 | * | 10/2005 | Choo | 182/82 |

FOREIGN PATENT DOCUMENTS

| | | | |
|---|---|---|---|
| AT | 31 959 | | 5/1984 |
| CN | 25 86 771 | | 11/2003 |
| EP | 0 034 819 | | 9/1981 |
| EP | 0 108 697 | | 5/1984 |
| FR | 2 298 662 | | 8/1976 |
| FR | 2487410 | A * | 1/1982 |
| FR | 2 487 892 | | 2/1982 |
| JP | 55-159068 | | 12/1980 |

(Continued)

*Primary Examiner* — Katherine Mitchell
*Assistant Examiner* — Daniel Cahn
(74) *Attorney, Agent, or Firm* — Paul Vincent

(57) ABSTRACT

A rail-guided climbing system having climbing brackets (36, 38, 40) in which climbing rails (32, 34) are guided, rigidly fixed to a scaffolding unit (12). Each climbing bracket (32, 34) has a joint (52) arranged between a first climbing bracket (40) and a second climbing bracket (38). The free end of the climbing rail (32, 34) may be inserted into a climbing bracket (36, 40) rigidly fixed on the construction (16) and the angular position of adjacent climbing rail sections (48, 50) is adjusted via the joint (52) using an adjuster device (58, 68).

8 Claims, 6 Drawing Sheets

(56) References Cited

FOREIGN PATENT DOCUMENTS

| | | | | | |
|---|---|---|---|---|---|
| JP | 08-144514 | | | 6/1996 | |
| JP | 08-505912 | | | 6/1996 | |
| JP | 2003-97092 | | | 4/2003 | |
| WO | WO 03097493 | | * | 11/2003 | |
| WO | WO 03097493 | A1 | * | 11/2003 | |
| WO | WO 2004020766 | A1 | * | 3/2004 | ..... E04G 21/32 |
| WO | WO 2005/054604 | | | 6/2005 | |

* cited by examiner

RAIL-GUIDED CLIMBING SYSTEM

This application is the national stage of PCT/DE2006/001050 filed on Jun. 20, 2006 and also claims Paris Convention priority to DE 10 2005 030 336.6 filed on Jun. 29, 2005.

BACKGROUND OF THE INVENTION

The invention relates to a rail-guided climbing system with climbing rails guided in climbing brackets which are integrated in a scaffolding unit, wherein the rail guided climbing system can be used as a climbing formwork.

Such a climbing formwork has been known through the climbing formwork GCS of the Doka Schalungstechnik GmbH.

The known climbing formwork GCS can be used on the construction as a guided crane climbing system. In a repositioning of the climbing formwork on the construction with a crane, the formwork and the scaffolding remain on the building. The overall unit comprising a formwork, a scaffolding and climbing rails is repositioned. Gravitational handles are integrated in the climbing rails, which lock into hinged brackets, wherein the hinged brackets are rigidly fixed on the construction. The known climbing rails are formed as flexural-resistant, integral climbing rails.

From FR 24 87 892 A a climbing system is known, particularly for a climbing scaffold. Anchorages are provided along a concrete wall in regular intervals. A support serving as a climbing rail is firmly connected at its upper end to a rail and held by means thereof in two anchorages. A lifting cylinder is provided at the lower end of the support, the piston of which is firmly connected to a brace. By means of the brace, the bracket supports itself on a brace console fixed in a lower anchorage. This is slideably arranged on a bar by means of a joint provided at the free end of the bracket. The bar is fastened on the brace console and vertically oriented towards the wall. Through a displacement of the joint on the bar, the angle of the brace can be adjusted in relation to the wall.

The object of the invention is to provide a rail-guided climbing system that is simple and versatile in application and may also be used as a self-climbing system.

The object is solved according to the invention in that each climbing rail comprises climbing rail sections which are connected with one another at their adjacent ends by means of a joint provided between a first and a second climbing bracket or in the region of a third climbing bracket, that the free end of the climbing rail may be inserted in a climbing bracket rigidly fixed on the construction and that the climbing rail sections adjacent to the joint can be adjusted in their angular position to one another via the joint by means of an adjustor device.

SUMMARY OF THE INVENTION

The rail-guided climbing system according to the invention has thereby the essential advantage that by means of the joint formed on the respective climbing rail, repositioning procedures on the construction to be erected from concreting section to concreting section can take place more simply. If a concreting section is completed, then climbing brackets are fastened to the anchor points formed there. Subsequently, the rail-guided climbing system is repositioned either by having it lifted by a crane or self-climbing by a lifting cylinder (climbing cylinder). The free ends of the climbing rails are navigated thereby by means of an adjustor device such that they can slide into the climbing brackets provided. With the joint provided at each climbing rail all of the irregularities appearing on the construction can be compensated. The joint gives each climbing rail an increased moveability so that over an adjustable angular position of the adjacent climbing rail sections dimensional changes resulting from the dead weight of the system, a varying wind load or from construction sections completed within the allowable tolerance threshold, etc. can be compensated. That means a planned repositioning operation of a completed concrete section to a concrete section to be manufactured can be carried out without adjustment work. This increases the versatility of the inventive system. It can adapt itself to unforeseen structural changes without additional effort. The rail-guided climbing system obtains its static stability through a brace framework construction, i.e., the necessary overall flexural rigidity of the system is achieved by the integration of the climbing rails into the scaffolding unit.

Concreting sections can be constructed with the rail-guided climbing system which taper or expand compared to the previously constructed concreting section. For example, with increasing construction height conically tapering or conically expanding constructions are made without having to undertake any structural alterations on the rail-guided climbing system according to the invention. The flexibility of the system according to the invention is only limited by the size of the angular deflection of the joint. Preferably, the first climbing rail section can be pivoted around the joint compared to the second climbing rail section up to 5°, both towards a construction as well as away from a construction.

The rail-guided climbing system preferably forms a unit composed of two climbing rails which run parallel-spaced to one another and which are integrated in a scaffolding unit. When necessary, a plurality of units of rail-guided climbing systems of this type can be mounted to a construction next to each other. These units can be lifted, respectively, lowered independently of each other (by a crane or by a climbing cylinder).

In a preferred embodiment along a climbing rail transverse to its longitudinal extension load-bearing bolts are provided which lie on a pivotally mounted handle of the climbing bracket.

This has the advantage that the climbing rails can be most easily assembled and no handle systems have to be fastened to the climbing rails. In an embodiment two U-profiles spaced apart from one another are connected together via load-bearing bolts, wherein the legs of the U-shape are directed outwards. In the clearance between the U-profiles spaced apart and at the circumference of the U-profiles the scaffolding unit and an arbitrary number of braces can be attached without difficulty so that with the simplest means a buckling-resistant unit can be assembled.

In a further design of the invention, the adjuster device is formed as a spindle which supports itself on the one hand in the region of the second climbing rail section and on the other hand in the region of the first climbing rail section.

This has the advantage that by means of a shortening of the length, respectively, a lengthening of the spindle, the first climbing rail section can be deflected compared to the second climbing rail section, as required. The deflection occurs only in a dimension such that the free end of the climbing rails by a repositioning operation upwards, for example, can move in the climbing bracket provided without interference. When tapering or expanding concreting sections are erected adjacent to erected concreting sections, then a further diagonal brace provided in the scaffolding unit can also be formed as a spindle with which the enlarged dimension of the deflection of the joint is adjusted.

The handles of the climbing brackets have an inclined contact surface, which by movement of the climbing rail relative to the handles at the load bearing bolts and without engagement, are pivoted relative to the load-bearing bolts, and in the contact-free position relative to the load-bearing bolts, the handles automatically pivot back to their initial position. This has the advantage that in a repositioning operation upwards the handles do not block the displacement process but release it without additional work on the system. If a repositioning procedure is supposed to occur downwards, the handles can be unlocked by hand and a subsequent locking takes place again automatically or by hand.

In a further preferred design of the invention the climbing bracket is composed of a wall or ceiling connecting part and a slide shoe part, wherein the slide shoe part is engaged with the climbing rail and/or can be engaged with the climbing rail. This has the advantage that the wall or ceiling connecting part can always be adapted to available anchor systems and also structurally can be formed such that it can be fastened to conventional anchor systems. If a construction is erected in frame construction, a ceiling connecting part can be fixed to an erected ceiling, and this ceiling connecting part is connected to the slide shoe such that the slide shoe part can accommodate the climbing rail and/or is engaged with the respective climbing rail.

If the slide shoe part is arranged hinged at the wall or ceiling connecting part, then the movability of the entire system is further increased and the individual components can be more simply adjusted relative to one another.

The wall or ceiling connecting part in the condition to be fastened and/or in a fastened condition at the construction is preferably pivotal around a vertically oriented axis. This enables, in addition, the compensation of irregularities on the construction and facilitates the fastening of the rail-guided climbing system on the construction.

Claws encompassing the climbing rails are preferably provided on the slide shoe part, wherein the claws can be brought out of engagement with the climbing rails, particularly through a pivoting and/or telescoping movement. It is ensured by the claws, on the one hand, that the climbing rails are kept securely guided on the construction, and within the claws the climbing rails can be driven upwards, respectively, downwards. Through a pivoting or telescoping procedure, the slide shoe parts can be simply removed from the climbing rail. This is so even if the climbing rail is still engaged with the climbing bracket. Climbing brackets can already be dismantled on the construction when they are no longer needed and this also when the climbing rail has not yet been retracted from the climbing brackets.

If a climbing cylinder is provided at the second or third climbing bracket, the climbing rail can be moved relative to the climbing brackets. A lifting by crane is no longer necessary. The climbing cylinders are provided on both climbing rails and the lifting movement of the climbing cylinder is synchronized. The climbing cylinders concern a self-climbing, rail-guided climbing system and a crane for moving the system is no longer required. The adapter device allows for an undisturbed climbing movement because over the adjuster device the free ends of the climbing rail can be navigated such that they can run in the adjacent climbing brackets without interference during a climbing procedure. In the climbing bracket, the load-bearing bolts of the climbing rails move the handles of the climbing brackets such that an undisturbed lifting process can take place. After the passage of a load-bearing bolt through the respective climbing bracket, the handle pivots back into a locking position so that the climbing rails can no longer be moved downwards. The climbing cylinder supports itself on a climbing bracket and is detachably fastened at this climbing bracket. When the repositioning procedure is completed, the climbing cylinder can be removed from the climbing bracket and mounted again on a higher climbing bracket compared to this climbing bracket so that, when required, the next successive repositioning process can be initiated.

A pivotal handle is provided at the free end of the climbing cylinder which can be brought into engagement with the load-bearing bolts. The climbing cylinder preferably has a hydraulic moveable piston whose lift is adjusted to the intervals of the load-bearing bolts in the climbing rails. The pistons of the climbing cylinder can be driven in and out of the climbing cylinder. If the pistons in the climbing cylinder are driven in, then the handle pivots out of the engagement of the load-bearing bolts over an inclined contact surface and then engage automatically at the next load-bearing bolt on which the pivotal handle abuts. With such a construction a self-climbing lifting, respectively, a self-climbing lowering of the rail-guided climbing system can be simply effected. The load-bearing bolts are provided at desired intervals over the entire length of the climbing rails. The climbing rails themselves preferably have a length which is greater than the height of two concreting sections.

BRIEF DESCRIPTION OF THE DRAWING

In the following drawings, the rail-guided climbing system according to the invention is described by one of several possible exemplary embodiments. In the figures.

DESCRIPTION OF THE PREFERRED EMBODIMENT

Figure 1:
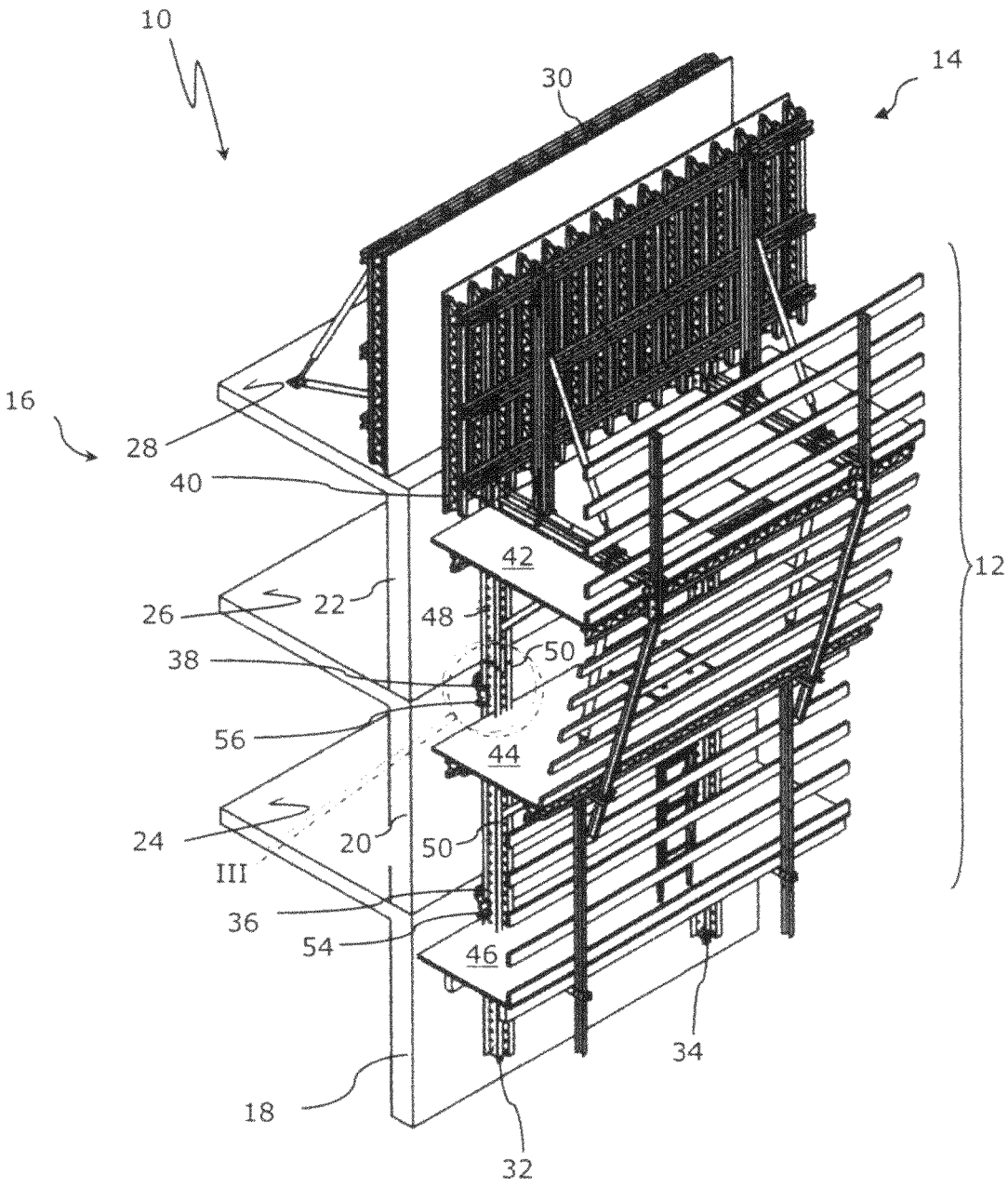
FIG. 1 shows a general view of the rail-guided climbing system in a three-dimensional representation.

FIG. 1 shows with the reference numeral 10 the rail-guided climbing system according to the invention in a spatial representation with a scaffolding unit 12, which carries an external formwork 14. The rail-guided climbing system 10 is fastened at the construction 16 to the extent that this is already erected. From the construction 16 a first concreting section 18, a second concreting section 20 and a third concreting section 22 is made and further concreting sections are supposed to be made at the construction 16 with the rail-guided climbing system 10 according to the invention.

From the already erected concreting sections 18 to 22 ceiling sections 24, 26, 28 are also insinuated and on the ceiling section 28 a conventional internal formwork 30 is built up, which is supported by the ceiling section 28.

In the scaffolding unit 12 a first climbing rail 32 and a second climbing rail 34 are integrated. The framework of the scaffolding unit 12 is connected with the climbing rails 32, 34 such that the rail-guided climbing system 10 is formed statically stable. The climbing rails 32, 34 are guided in climbing brackets 36, 38, 40 and at least in one climbing bracket pair, for example, the climbing brackets 38, are held downwardly immovable. The climbing brackets 36, 38, 40 are also provided at the second climbing rail 34. In the figures these climbing brackets are hidden by other structural elements of the rail-guided climbing system 10.

The scaffolding unit 12 has a first platform 42, a second platform 44 and a third platform 46. On the first platform 42 the moveable external formwork 14 is set up and by means of this first platform 42 climbing brackets can be simply and safely fastened on the anchor points provided, when the external formwork 14 is moved away from a concreting section constructed and hardened. By means of a second platform 44, the second climbing bracket 38, respectively, the second climbing bracket pair 38 are easily accessible for the operating personnel and by means of the third platform 46 the respective third climbing bracket 36 is mounted, respectively, dismantled.

The climbing rails 32, 34 are formed from a respective first climbing rail section 48 and a second climbing rail section 50. The climbing sections 48, 50 are connected together with one another by means of a joint 52. The first climbing rail section 48 can be deflected compared to the second climbing rail section 50, and/or vice versa. The climbing rail sections 48, 50 are safely kept guided by means of claws 54, 56 of the climbing brackets 36 to 40 with the claws 54, 56 encompassing a U-shaped profile on a side of the U-shaped leg on both sides. The claws 54, 56 are formed on all climbing brackets 36 to 40 and all climbing brackets are preferably formed structurally identical so that they can be interchanged arbitrarily.

The rail-guided climbing system 10 can be moved safely along the climbing brackets 36 to 40 on the construction 16. The climbing brackets 36 to 40 have holding means which can hold the climbing rails 32 and 34 in the desired position on the construction 16. From the rail-guided climbing system 10 only one construction unit is shown in FIG. 1. If the concreting sections 18 to 22 are wider, then an arbitrary amount of rail-guided climbing systems 10 can be mounted on construction 16 which can be relocated independently from one another, i.e., shifted.

Figure 2:
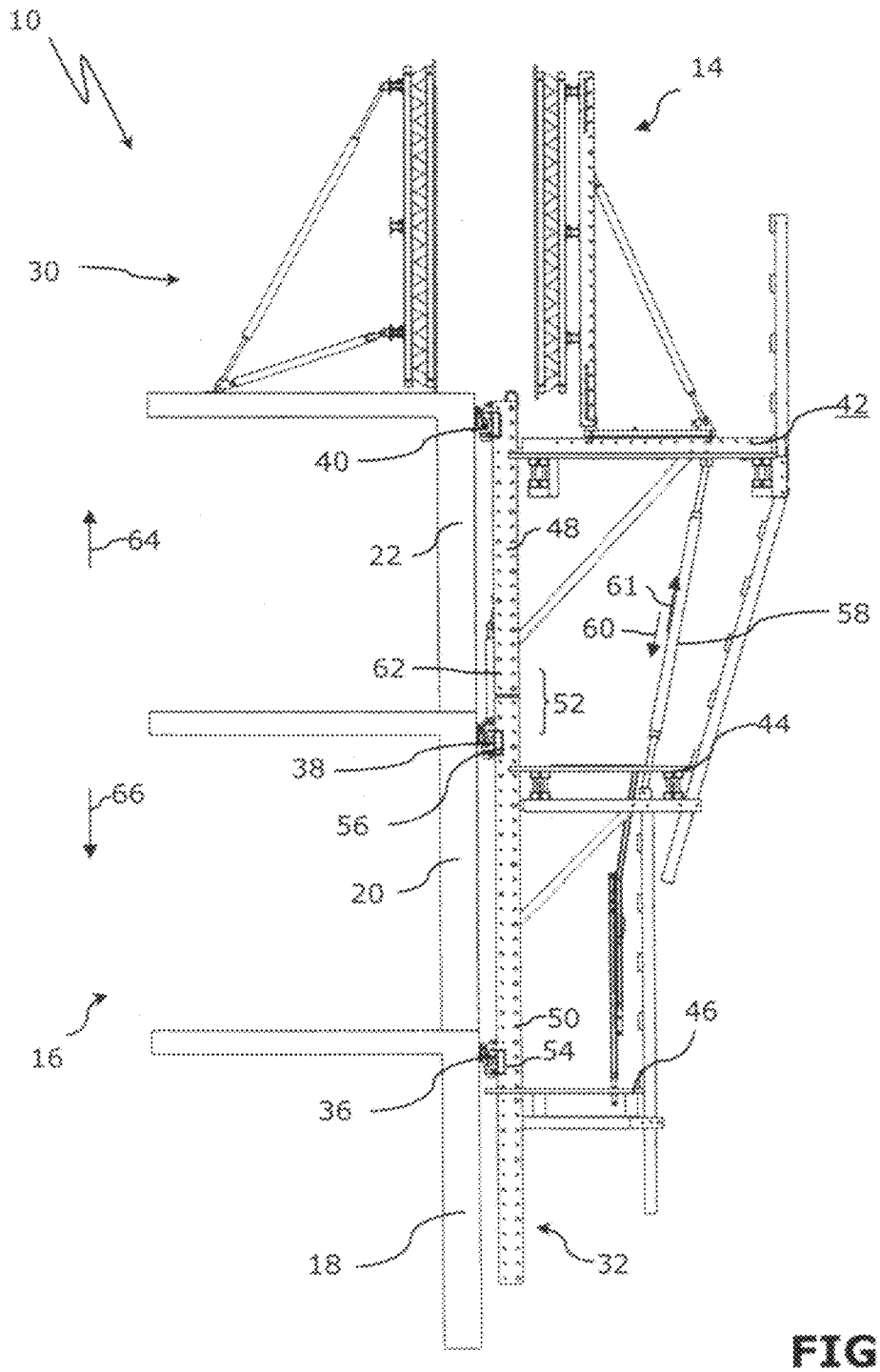
FIG. 2 shows a side view of the rail-guided climbing system according to the invention

FIG. 2 shows the rail-guided climbing system 10 according to the invention in a side view with the concreting sections 18 to 22 already erected. A further concreting section is to be erected following the third concreting section 22. For this, the external formwork 14 and the internal formwork 30 are arranged on the third concreting section 22 such that an outer wall corresponding to the concreting sections 18 to 22 can be formed in concrete. The external formwork 14 is moveably arranged on the first platform 42. The climbing rail sections 48 and 50 are guided and safely held in the climbing brackets 36 to 40. In the region of the second climbing bracket 38 a spindle 58 is provided, which serves as an adjustor device for the joint 52. In the direction of arrows 60, 61, the spindle 58 can be extended and/or shortened so that by means of the spindle 58 the first climbing rail section 48 with respect to the second climbing rail section 50 can be oriented such that it can be moved in the first climbing bracket 40 without interference. In the drawing, the first climbing rail section 48 is shown already inserted into the climbing bracket 40. A climbing cylinder 62 which is shown in the inserted state in the figure is fastened on the second climbing bracket 38 which is connected, like climbing brackets 36 and 40, in a fixed manner with the construction 16 via an anchor point provided at the corresponding concreting sections 18 to 22. The climbing cylinder 62 supports itself on the one side on the second climbing bracket 38 and if the piston is extended from the climbing cylinder 62, then the rail-guided climbing system 10 can be moved in the direction of the arrow 64 relative to the climbing brackets 36 to 40. Likewise the rail-guided climbing system 10 can be lowered via the climbing cylinder 62, if necessary, in the direction of the arrow 66 relative to the climbing brackets 36 to 40.

In the position shown in FIG. 2 the third climbing bracket 36 can already be dismantled during the production of a new concreting section following the third concreting section 22. The rail-guided climbing system 10 is exclusively guided and held by the second climbing bracket 38 and the first climbing bracket 40. If the fourth concreting section is erected and hardened, the external formwork 14 can then be moved backwards to the first platform 42 and the third climbing bracket 36 and/or the third climbing brackets 36 can be fastened at the new erected concreting section at the anchor points provided there. Subsequently, the piston of the climbing cylinder 62 is extended and the climbing rail 32 moves with the scaffolding unit and the external formwork 14 in the direction of the arrow 64. The rail-guided climbing system 10 shown in FIG. 2 is designed to be self-climbing over the climbing cylinder 62, so that a crane is not necessary for the repositioning procedure to a concreting section to be subsequently erected. The joint 52 is oriented via spindle 58 such that the first climbing rail section 48 drives freely into the climbing bracket lying above the free end of the first climbing rail section 48. Simultaneously with the first climbing rail 32, the second climbing rail 34 is travelling which is rigidly connected via the scaffolding unit with the first climbing rail 32. The second climbing rail 34 is likewise lifted by means of a climbing cylinder 62. The lift movements of the climbing cylinders 62 at the climbing rails 32 and 34 are coordinated.

Figure 3:
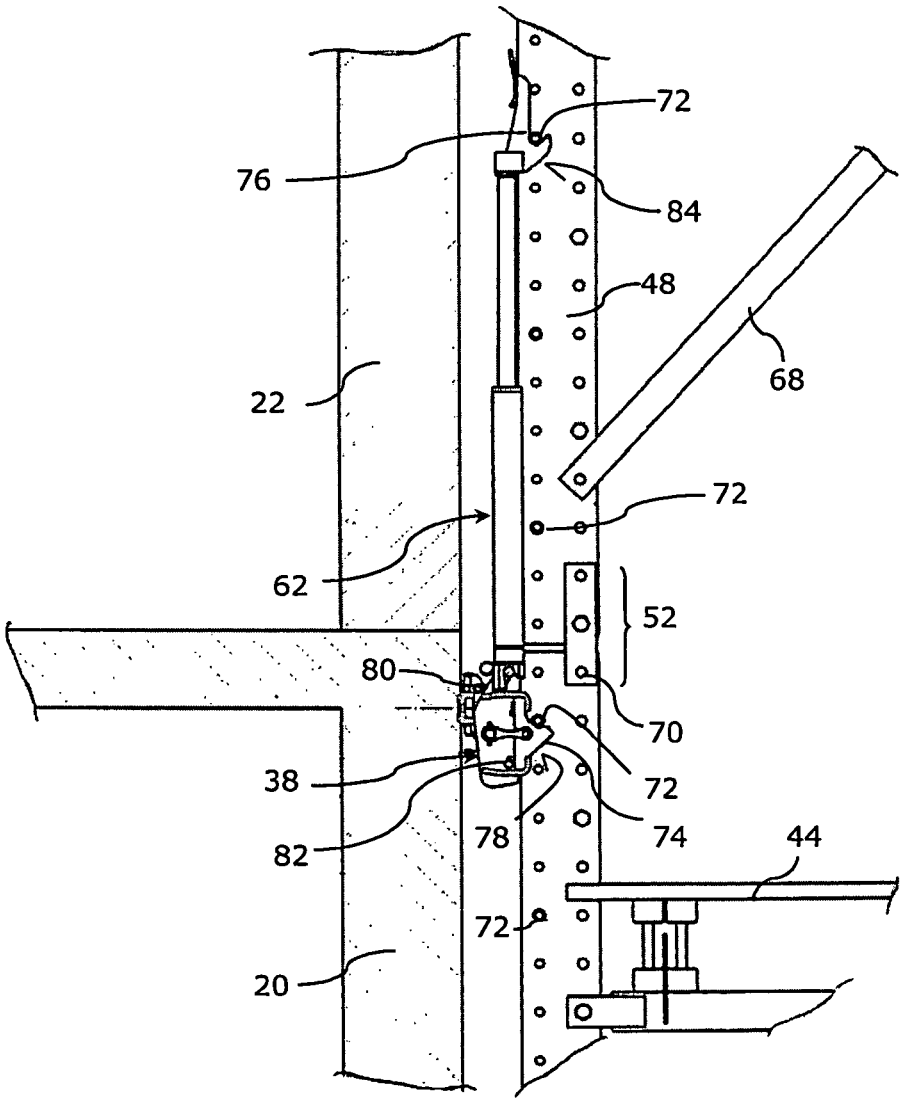
FIG. 3 shows a section of the climbing system according to the invention in accordance with III from FIG. 1 with a climbing rail elevation, so that the holder of the climbing rail at the climbing bracket by means of the load-bearing bolts can be shown.

FIG. 3 shows a partial sectional view from III of FIG. 1 and shows both the second climbing rail section 50 as well as an elevation of the climbing rail section 48 so that the fastening points of the climbing bracket 38 and the climbing cylinder 62 at the first climbing rail section 48 and at the second climbing rail section 50 can be shown. Insinuated in the drawing is also a diagonal brace 68 by means of which the rail-guided climbing system is buttressed. The joint 52 has a pivot 70 around which the first climbing rail section 48 and the second climbing rail section 50 can be pivoted through an angular range. In the drawing an angle of about 5° is shown.

The climbing rail sections 48, 50 are formed from U-shaped profiles, which are fastened together spaced apart from each other via load-bearing bolts 72. In the clearance of the climbing rail sections a pivotally mounted handle 74 of the climbing bracket 38 projects and grasps under a load-bearing bolt 72. The handle 74 is formed such that it holds the rail-guided climbing system together with a corresponding handle of another climbing bracket for the second climbing rail. At the free end of the climbing cylinder 62 a pivotally mounted handle 76 is formed which can also grasp under the load-bearing bolt 72. In the figure, the climbing cylinder 62 is shown in the extended state. As soon as the handle 74 which holds the second climbing rail section 50 grasps under the load-bearing bolt the piston of the climbing cylinder 62 can be retracted. In a lower position the pivotal handle 76 grasps under the load-bearing bolt 72 again and the piston of the climbing cylinder 62 can be extended again so that the climbing rail sections 48, 50 move upwards relative to the climbing bracket 38. In this climbing procedure, a load-bearing bolt 72 presses on an inclined contact surface 78 of the handle 74 and pivots the handle out of the locked position shown such that a load-bearing bolt 72 running past can pass over the handle 74. If the load-bearing bolt 72 no longer touches the handle 74, then it pivots automatically back in the position shown and prevents a downward movement of the climbing rail section 48, 50.

The climbing bracket 38 is formed in two parts as a wall or a ceiling connecting part 80 and with a slide shoe part 82. The wall or ceiling connecting part 80 is rigidly fixed by means of an anchor point to the second concreting section 20 and on the wall or ceiling connecting part 80 the slide shoe 82 is held hinged, pivotal around a horizontal axis. The wall or ceiling connecting part 80 can be pivoted, if required, around a vertically oriented axis in the assembled condition at the second concreting section 20. The climbing cylinder 62 is detachably fastened on the second climbing bracket 38.

If the piston of climbing cylinder 62 shown in FIG. 3 is retracted, then the handle 76 pivots as soon as it comes in contact with a load-bearing bolt 72 via the inclined contact surface 84 out of the engagement region of a load-bearing bolt 72, then the handle 76 pivots spring-loaded back into the position shown in FIG. 3 and during the extension of the piston can again encompasses a load-bearing bolt 72.

The slide shoe 82 is formed such that it can be separated so that it can be taken from both the wall or the ceiling connecting part 80 as well as from the second climbing rail section 50 and this also when the second climbing rail section 50 is still encompassed by the claws of the climbing bracket 38.

Figure 4:
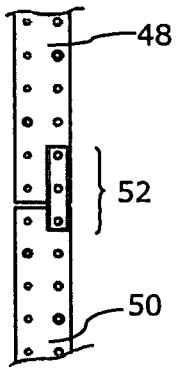
FIGS. 4-6 show different deflections of a joint at the climbing rail sections according to the invention.
Figure 5:
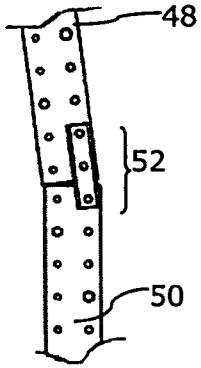
Figure 6:
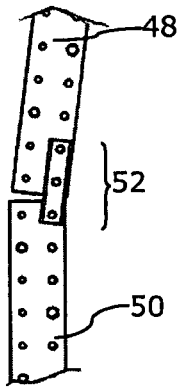

FIGS. 4 to 6 show different positions of the joint 52. Sections of the first and second climbing rail sections 48 50 are thereby shown. In FIG. 4 the climbing rail sections 48, 50 are oriented aligned. In FIG. 5 the first climbing rail section 48 is shown inwardly inclined with respect to the climbing rail section 50 and in FIG. 6 the first climbing rail section 48 is outwardly inclined with respect to the second climbing rail section 50. By means of the joint 52 the first climbing rail section 48 can be inclined approximately 5° inwardly, and/or approximately 5° outwardly inclined with respect to the second climbing rail section 50.

Figure 7:
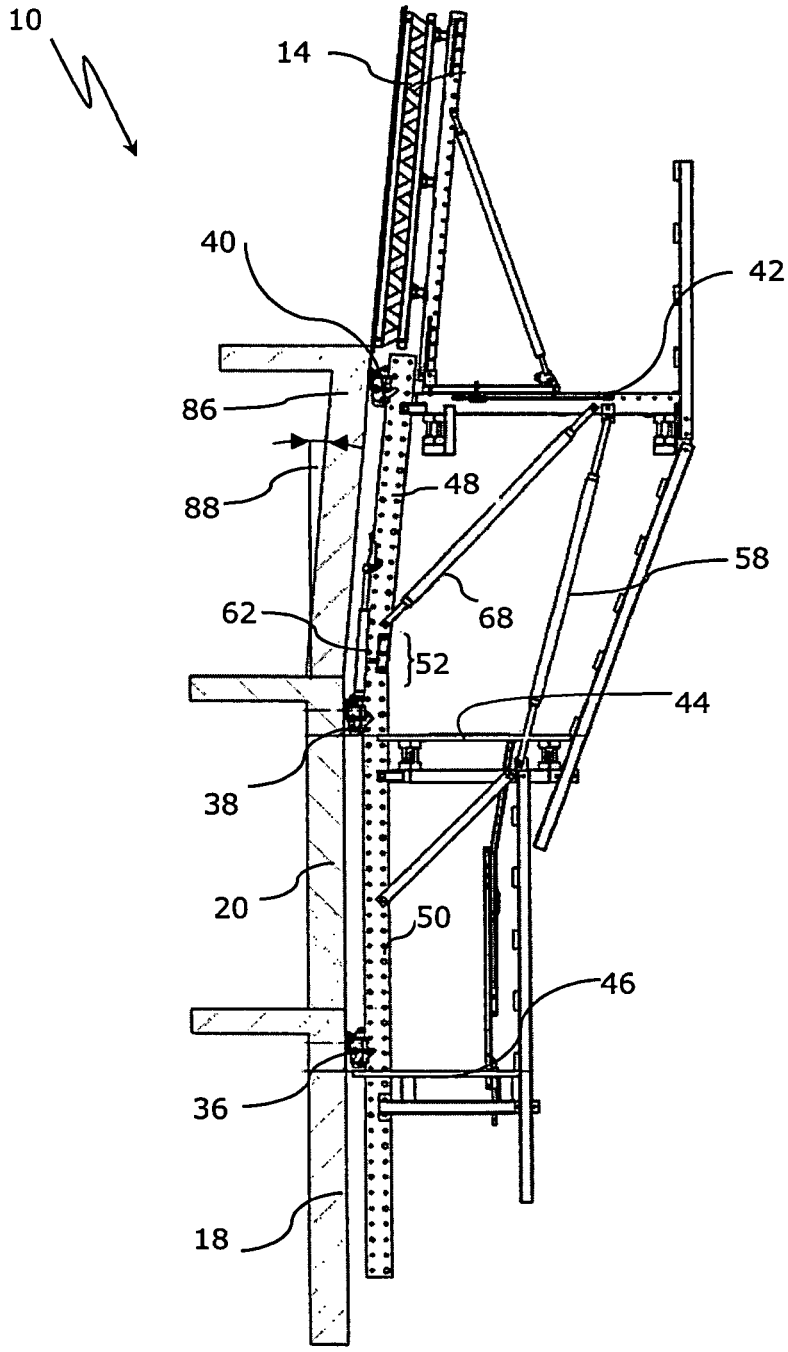
FIG. 7 shows a side view of a self-expanding construction with a rail-guided climbing system according to the invention.

FIG. 7 shows the rail-guided climbing system according to the invention with the completed concreting sections 18 and 20, in which a third concreting section 86 follows expanding to the outside. The construction shown in FIG. 7 expands outwardly by an angle 88 of ca. 5°, that is, an outward inclination of the third concreting section 86 with respect to the second concreting section 20 takes place. The new concreting section to be erected is also supposed to be inclined to the outside so that a diagonal brace 68 is formed as a spindle. Over the adjustable diagonal brace, here a spindle 68, the inclination of the joint is adjusted. For the adjustment of the inclination, spindle 58 is also necessary, whose length also has to be adapted to the desired inclination. The adjustments of the spindles 58, 68 take place from the second platform 44. The external formwork 14 can be moved via the first platform 42 into a desired position and via the third platform 46 the third climbing bracket 36 can be dismantled. Via the climbing cylinder 62 the climbing rail with the climbing rail sections 48, 50 was moved into the position shown in the drawing and the climbing brackets 36, 38, 40 guide and hold the climbing rail sections 48, 50 at the concreting sections 18, 20, 86.

Figure 8:
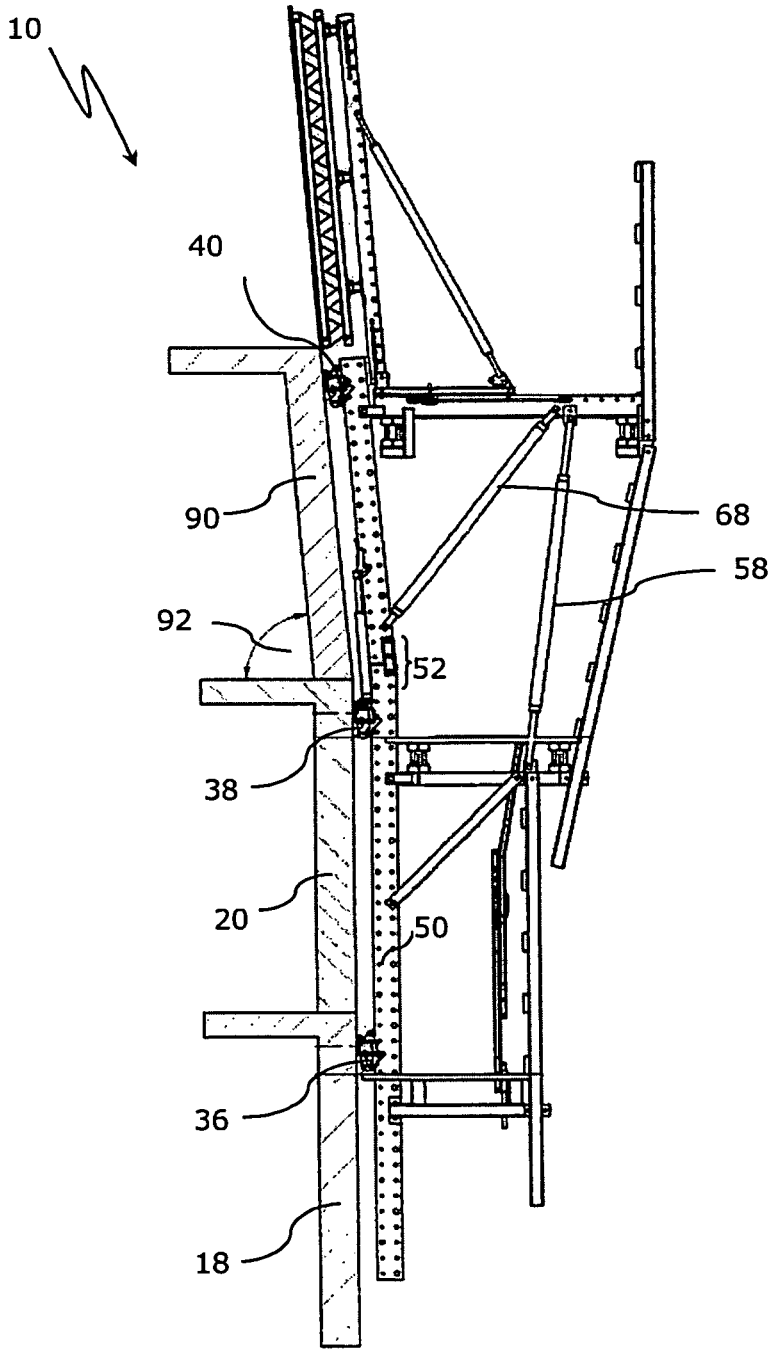
FIG. 8 shows a side view of a tapering construction with a rail-guided climbing system according to the invention.

FIG. 8 shows the concreting sections 18, 20 on which a tapering concreting section 90 follows. The inclination of the third concreting section 90 compared to the second concreting section 20 amounts to about 5° so that an angle 92 of 85° is reached. The joint 52 was correspondingly deflected by the spindles 58, 68.

A rail-guided climbing system comprises climbing brackets 36, 38, 40 in which climbing rails 32, 34 are guided, rigidly fixed to a scaffolding unit 12. Each climbing bracket 32, 34 comprises a joint 52 arranged between a first climbing bracket 40 and a second bracket 38. The free end of the climbing rail 32, 34 is inserted into a climbing bracket 36, 40 rigidly fixed on the construction 16 and the angular position of adjacent climbing rail sections 48, 50 is adjusted via the joint 52 by means of an adjuster device 58, 68.

I claim:

1. A rail-guided climbing system, the climbing system structured to support and lift a scaffold unit of a climbing formwork to build a structure having a wall, the climbing system comprising:

a first climbing bracket structured for attachment to the wall at a first wall location;

a second climbing bracket structured for attachment to the wall at a second wall location disposed above said first wall location;

a third climbing bracket structured for attachment to the wall at a third wall location disposed above said second wall location;

a first climbing rail section;

a second climbing rail section disposed above said first climbing rail section;

a joint disposed between and directly connecting a lower end of said second climbing rail section to an upper end of said first climbing rail section, said first and said second climbing rail sections being capable of moving between a lower position and an upper position, wherein, in said lower position of said first and said second climbing rail sections, said joint is disposed below said second climbing bracket, said first climbing rail section is guided in said first climbing bracket and said second climbing rail section is guided in said second climbing bracket, wherein, in said upper position of said first and said second climbing rail sections, said joint is disposed above said second climbing bracket, said first climbing rail section is guided in said second climbing bracket and said second climbing rail section is guided in said third climbing bracket;

a first platform directly connected and extending substantially perpendicular to said first climbing rail for a user to stand upon;

a second platform directly connected and extending substantially perpendicular to said second climbing rail for a user to stand upon; and an adjustor device directly connected between said first platform and said second platform, said adjustor device disposed, structured and dimensioned for adjusting and maintaining an angular orientation between said first and said second climbing rail sections via said joint to facilitate insertion of an upper free end of said second climbing rail section into said third climbing bracket when said first and said second climbing rail sections are being raised from said lower position into said upper position.

2. The rail-guided climbing system of claim 1, wherein said first and said second climbing rail sections have a plurality of transverse load-bearing bolts, said bolts cooperating with pivotably mounted bracket handles of said first, said second and said third climbing brackets.

3. The rail-guided climbing system of claim 1, wherein said adjustor device is formed as a spindle having a first end connected to said first platform and a second end connected to said second platform.

4. The rail-guided climbing system of claim 2, wherein each of said handles of said first, second and third climbing brackets abut against and pivot out of engagement with said load-bearing bolts when said first and said second climbing rail sections are being raised, wherein, after passage of said load-bearing bolts, said handles automatically pivot back into a locking position.

5. The rail-guided climbing system of claim 1, wherein each of said first, said second and said third climbing brackets comprises a connecting part and a slide shoe, each of said respective connecting parts being structured for mounting to the wall, wherein each of said respective slide shoes engages said first or said second climbing rail section.

6. The rail-guided climbing system of claim 2, further comprising a climbing cylinder connected between one of said first, said second and said third climbing brackets and said second climbing rail section to move said first and said second climbing rail sections relative to said first, said second and said third climbing brackets.

7. The rail-guided climbing system of claim 6, wherein a cylinder pivot handle is disposed at a free end of said climbing cylinder for engagement with said load-bearing bolts.

8. The rail-guided climbing system of claim 7, wherein said cylinder pivot handle has an inclined contact surface.

* * * * *